US005181468A

United States Patent [19]

Borel

[11] Patent Number: 5,181,468

[45] Date of Patent: Jan. 26, 1993

[54] PRETENSIONED JACK FOR CONTROLLING THE OPERATING PRESSURE BETWEEN TWO ROTARY CYLINDERS

[75] Inventor: Edouard Borel, Corcelles-Sur Chavornay, Switzerland

[73] Assignee: Bobst SA, Switzerland

[21] Appl. No.: 689,481

[22] Filed: Apr. 23, 1991

[30] Foreign Application Priority Data

Apr. 26, 1990 [CH] Switzerland ..... 1419/90

[51] Int. Cl.[5] ..... B41F 7/04; F15B 15/00

[52] U.S. Cl. ..... 101/216; 92/13.4; 92/13.6; 92/13.8; 100/170; 101/247

[58] Field of Search ..... 101/152, 153, 218, 247, 101/139, 140, 144, 145, 182, 184, 185, 192, 216; 384/99; 100/168, 169, 170; 92/13.1, 13.3, 13.4, 13.6, 13.7, 13.8

[56] References Cited

U.S. PATENT DOCUMENTS

| | | | |
|---|---|---|---|
| 3,958,493 | 5/1976 | Fujita et al. | 92/13.6 |
| 4,169,405 | 10/1979 | Tsunemoto et al. | 92/13.6 |
| 4,185,879 | 1/1980 | Hars et al. | 101/182 |
| 4,676,158 | 6/1987 | Ishii et al. | 101/218 |
| 4,704,296 | 11/1987 | Leanna et al. | 427/9 |
| 4,736,678 | 4/1988 | Stotz | 100/170 |

FOREIGN PATENT DOCUMENTS

| | | | |
|---|---|---|---|
| 78496 | 5/1983 | European Pat. Off. | 92/13.1 |
| 2822531 | 11/1979 | Fed. Rep. of Germany . | |
| 2258267 | 8/1975 | France . | |
| 2411705 | 8/1979 | France | 101/247 |
| 2444828 | 7/1980 | France . | |

OTHER PUBLICATIONS

Hydraulic Pneumatic Power, vol. 17, No. 196, Apr., 1971 "Design Aspects of Hydraulic and Pneumatic Cylinders", by A. E. Constant, FIGS. 7 and 8.

Patent Abstracts of Japan, vol. 7, No. 261, Nov. 19, 1983, "Air Cylinder", Hiroshi Satou.

Patent Abstracts of Japan, vol. 12, No. 201, Jun. 10, 1988 "Pneumatic Cylinder Capable of Altering Double End Stopping Position", Ito Katsujiro.

*Primary Examiner*—Clifford D. Crowder
*Assistant Examiner*—Stephen R. Funk
*Attorney, Agent, or Firm*—Hill, Steadman & Simpson

[57] ABSTRACT

A device for controlling the operating pressure between the two rotary cylinders in a machine used for processing layers such as webs, ink films, or the like for instance on an offset printing machine. The device includes a pneumatic jack having an outlet rod of a piston thereof which acts to position each bearing supporting an end of a central shaft of a cylinder. When a chamber of the jack is subjected to pressure, the rod acts against the shift of the bearing in a direction which causes an increase of the distance between the two cylinders. A fixed, though adjustable, arresting piece acts against a shift of the bearing in a direction which would cause a reduction of the distance between the cylinders.

6 Claims, 2 Drawing Sheets

PRETENSIONED JACK FOR CONTROLLING THE OPERATING PRESSURE BETWEEN TWO ROTARY CYLINDERS

BACKGROUND OF THE INVENTION

The present invention concerns a device designed for controlling the operating pressure between two rotary cylinders in a machine used for processing layers such as webs, ink films, or the like.

An offset, flexographic, or rotogravure printing machine has at least a pair of rotary, or interacting cylinders (or rollers). The force tending to push these cylinders against one another is to be controlled accurately in the course of their processing a layer situated on their contact line (or surface). In the case of an offset printer, for example, the layer to be processed might be either a paper (or cardboard) web situated between the offset (or blanket) cylinder and the impression cylinder (or countercylinder), or else a thin ink film situated between the plate cylinder (or block cylinder) and the offset (or blanket) cylinder. Such cylinder pairs all have a common feature in that, in the course of a run, the two cylinders are to be pressed against one another so as to provide not only an operating pressure but also a pretension effect in such a way that even an interfering force of more than the operating pressure will not entail any difference of distance between axles. This pretension effect has been obtained up to now by means of running cables added to the radial periphery of both axial ends of the two cylinders.

However, such running cables have the following shortcomings:

an inherent seizing risk caused by inadequate lubrication due to lack of cleanness;

expensive cylinders;

the operating pressure can be modified only by changing the coating, unless the cables are put on eccentrics—which system, though, is complicated and expensive. At any rate, changing the operating pressure involves a machine stop, which is actually the main disadvantage.

Another negative feature existing on most of the arrangements of the prior art is the unchangeable distance between the PP-PB or PB-CC axles, which means that in the event of sudden overthickness, unfailing damage will occur on the blankets and the printing plate, or even of the bearings in particular cases.

SUMMARY OF THE INVENTION

It is an object of the present invention to discard the compulsory use of such running cables.

Another object of the present invention is to add a possible opening of the PP-PB or PB-CC slots, beginning with a bottom value corresponding to the pretension.

A further object of the present invention is to provide an appropriate guard for the machine.

According to the invention, a device is provided for controlling operating pressure between two interactive cylinders which are processing layers and wherein at least one of the cylinders has a movable central shaft for changing pressure between the cylinders at a contact line therebetween. A pneumatic jack is provided formed of an airtight sleeve and a movable piston. The piston has an outlet rod extension acting on a bearing which positions the central shaft of the at least one cylinder. The sleeve has a first airtight chamber which can be put under pressure which acts on a first side of the piston in such a way as to prevent the bearing attached to the central shaft of the cylinder from varying its position in a direction which would result in an increase of the distance and thus a reduction of the pressure on the contact line between the two cylinders. A fixed arresting piece is provided which can be appropriately positioned such that when applied against the piston, it prevents the bearing attached to the central shaft of the cylinder from shifting in a direction which would result in a reduction of the distance and an increase of the pressure along the contact line between the two cylinders.

DESCRIPTION OF THE PREFERRED EMBODIMENTS

Figure 1:
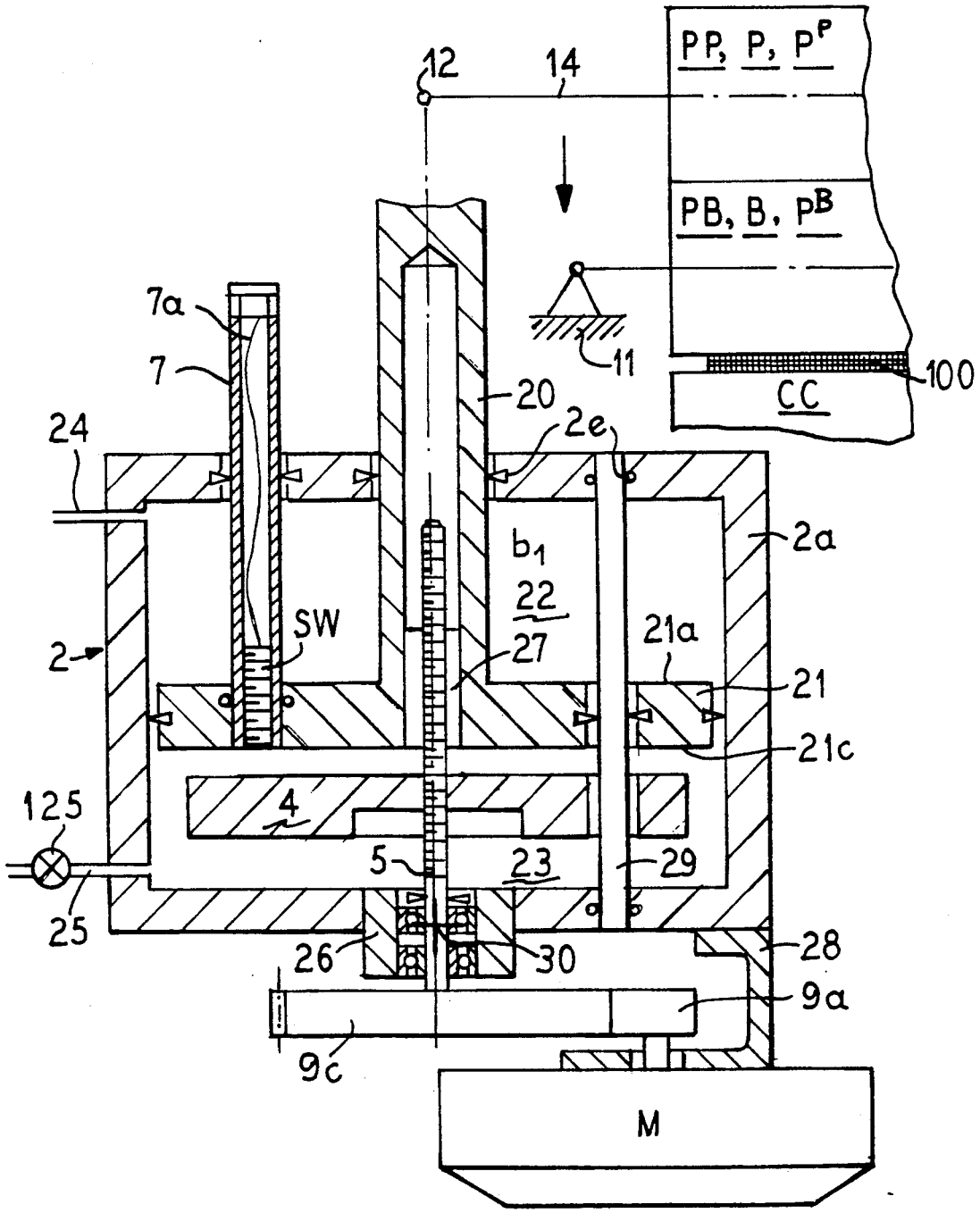
FIG. 1 is a sectional view of a controlling device for operating pressure between two rotary interactive cylinders in accordance with the invention.

The following comments include abbreviations with the following meanings:

p=cylinder
P=plate
PP=assembly of cylinder+plate
B=blanket
PB=assembly of cylinder+blanket
CC=counter-cylinder In the case of FIG. 1, the monitoring device is applied on the operating pressure setting device between the plate P fitted on the plate cylinder pB (assembly=PP) and the blanket B fitted on its cylinder pB (assembly=PB).

At both ends (only one being shown on FIG. 1), the central axle 10*a* of the cylinder PB is fitted for rotation on the fixed bearings 10 as shown on the machine frame 11. In FIG. 1, only half of the cylinders PP and PB are shown, it being understood that the other half is symmetrical. In the same way, the cylinders are shown in simple diagrammatic fashion since they are only represented for visualizing a possible way of using the device. It may suffice to remember in this connection that the plate P is a metal plate with a printable motif, the gravure being overlaid with ink which will be transferred onto the blanket B itself consisting of a resilient plate either fitted or glued on the cylinder PB in order to transfer the ink onto the web 100 to be printed. Consequently, it will be easily understood that the pressure with which the metal plate P is pressed or pushed towards the resilient blanket B will have a large influence on the behavior of the ink film compressed between the two opposite sides of the cylinders PP and PB. The purpose of the monitoring device referred to is to ensure easier and more reliable positioning and control of the operating pressure owing to severe monitoring of the distance between the two cylinders PP and PB.

For this purpose, each end of the central shaft 14 of the cylinder PP is fitted into a bearing 12 for free rotation, the bearing being normally shiftable vertically and taking its seat on the upper end of the outlet rod 20 of a pneumatic jack 2 (for practical reasons, this can be undone and bridged by means of a lever 8 (FIG. 2) or another mechanical piece which will have to be carefully made for high rigidity, also like the assembly described). The lower end of the rod 20, which is situated inside the cylindrical sleeve 2*a* of the jack, is provided with a piston 21 separating the inner volume of the sleeve 2*a* into two upper and lower pressure tight chambers 22 and 23. A duct 24 connected to a source of pressure (not represented) allows a pressure $b_1$ to build up within the upper chamber 22, whereas the lower chamber 23 is exposed to the free atmosphere through a duct 25 with an adjustable exhaust 125. Any downward shift of the piston 21 caused by the pressure $b_1$ when acting on its upper side 21*a* is controllable by means of an adjusting arresting piece having the shape of a dish or a disk 4 situated within the lower chamber 23 and which is allowed to be pushed against the lower side 21*c* of the piston 21. Owing to its central axis, the disk 4 is connected to a threaded rod so that with the rotation of the rod backward or forward, the disk 4 will be raised or lowered. The threaded rod 5 situated on the extension of the outlet rod 20 of the jack 2 is fitted so as to be able to rotate by means of a ball-bearing 26 within the lower wall, i.e. opposite the one crossed by the outlet rod 20 of the jack 2.

For the compactness of the assembly, the upper end of the threaded rod 5 is designed so as to penetrate into the lower, hollow, part of the outlet rod 20, a guiding bushing 27 being positioned between the two rods 20 and 5. The threaded rod 5 is rotated at its lower end by means of a servo-motor M, the outlet axle of which is provided with a toothed wheel 9*a* linked to another wheel 9*c* to be added to the threaded rod 5. The motor M is fitted immediately on the cylindrical sleeve 2*a* by means of an angle piece 28. In order to prevent the rotation of the piston 21 and the disk 4 within the sleeve 2*a*, both piston and disk are guided by a sliding vertical guiding rod 29 parallel to the outlet rod 20 and connected with both ends to the upper and lower walls of the cylindrical sleeve 2*a*. Each jack has a pivot which is not represented, but is symbolized by the cross 30, and with which it is attached to the frame 11. A vertical tube 7 is fitted at its lower end to the piston 21, whereas its upper end protrudes, from the upper wall of the cylinder 2*a* where it can freely slide and is air tight. At the lower end of the tube 7, a proximity detector switch SW shows the position of the piston 21 with respect to the disk 4. Another arrangement might include a rod fixed within the disk 4 and interconnecting the tube 7, which design allows the switch SW to be fitted outside the jack 2 at the end of the tube 7 with better access and the same function. The signals of the detector SW are transmitted through an electrical connection lead 7*a*. The jack 2 is provided with appropriate seals 2*e* in each area where necessary.

Figure 2:
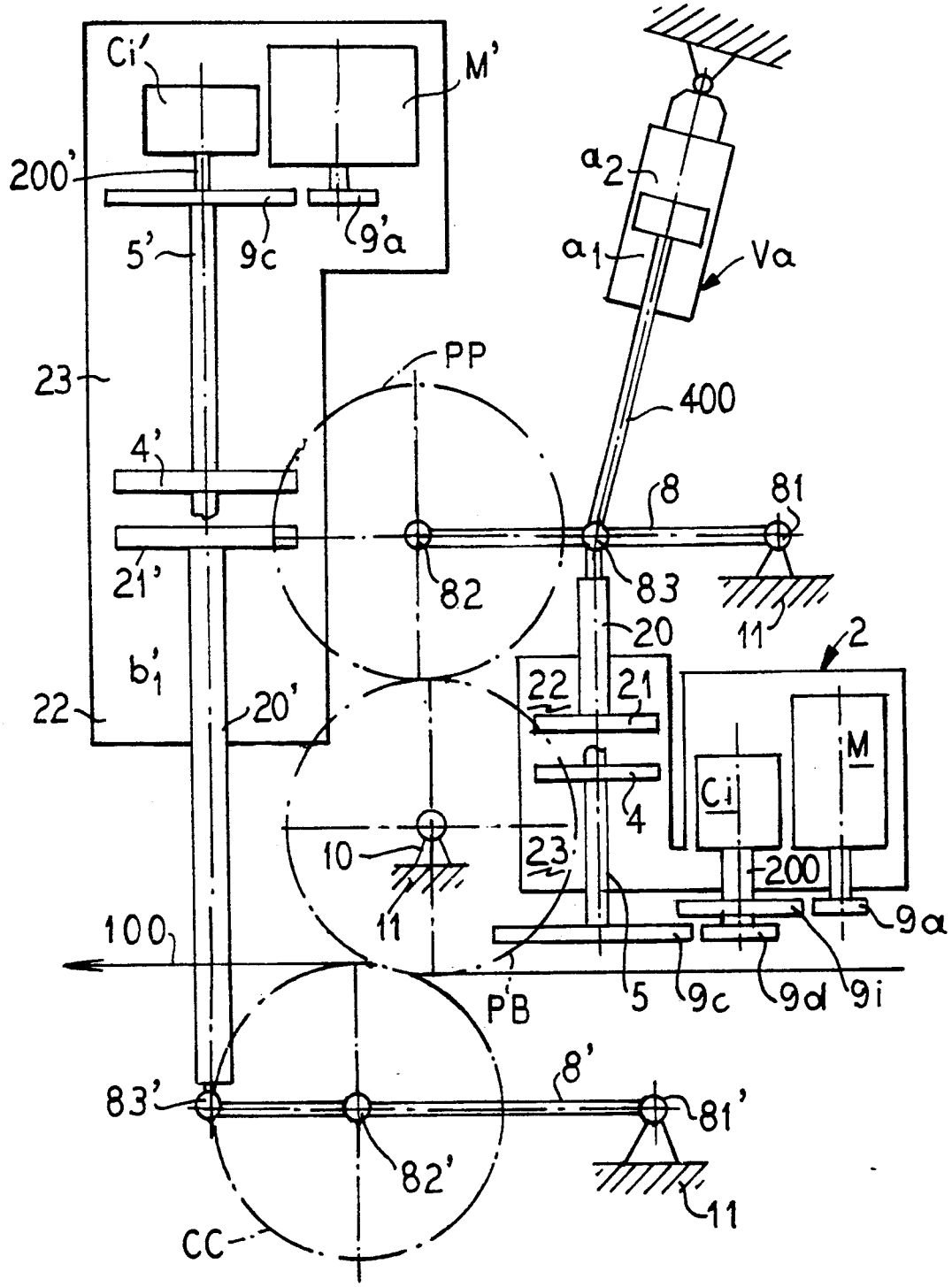
FIG. 2 is a simplified diagram illustrating the use of two such controlling devices within an offset printing machine.

FIG. 2 shows in which way two devices according to the invention can be used simultaneously on an offset printing machine for controlling pressure and distance between the blanket cylinder PB and the plate cylinder PP, as well as the counter-cylinder CC respectively. As indicated already, the cylinder CC is used, in the course of printing, to press a travelling web 100 against the cylinder PB. Consequently, it is also necessary for obtaining reliable printing quality to permanently control the operating pressure and the distance between the two cylinders PB and CC. On FIG. 2, the components identical to those of FIG. 1 have been identified with the same reference mark with the difference, though, that those concerning the controlling device of the cylinder CC bear the indice "1". Moreover, every controlling device according to FIG. 2 is provided with an incremental decoder Ci or C'i (connected to motor M or M' via wheels 9*a* or 9'*a*, the outlet axle 200, 200' of which is connected for rotation (by means of two toothed wheels 9*i* and 9*d* in the case of the decoder Ci) to the toothed wheel 9*c*, 9'*c* of the 5, 5'. Similarly, each end of the central shaft 14 of the cylinder PP rotates on a bearing 82 located at the end of a horizontal lever which itself tilts freely around an axle 81 situated at the other end and which is fitted on the machine frame 11. The outlet rod of the lever 8 so that, with the jack 2 subjected to pressure $b_1$, the rod 20 prevents the lever 8 from being raised and the cylinder PP from being moved away from the cylinder PB.

The controlling device can act in several ways with the two principal ones being as follows, starting always from an "open" position of the levers 8, 8' (FIG. 2):

for a new run, for example, the operator according to his experience is to choose a pressure value $b_1b_1'$ as required by the sheet width, the job, and other criteria.

The levers 8, 8' will then be applied and cause compression between PP and PB as well as PB and CC. The disks 4, 4' will then also be applied, whereupon the corresponding rotation of the motors M, M' is stopped through the proximity detector switch (such as SW shown in FIG. 1) at the moment of contact of the disks 4, 4' with their piston 21, 21'. The pressures $b_1$, $b_1'$ will then rise to a fixed, considerably higher, value, for instance 6 bar, thereby subjecting the system to pretension.

With that, the unit is ready for start-up, though the operator may at any moment change the operating pressure between PP and PB or PB and CC from the control desk, which action will be described further on. With every machine stop, each incremental decoder Ci, C'i will accurately record the position of the axle 14 with regard to the axle 10*a* on a diskette attributed to the run.

This will also allow a second mode, i.e.:

from the distant axles 82, 82', the disks 4, 4' are moved to their recorded operating position as described above owing to electronic positioning means relying on the incremental decoders Ci, C'i. The pressures $b_1$, $b_1'$ are switched on to their maximum rate with the effect of building up the operating pressures with pretension between PP and PB as well as PB and CC.

With that, the unit is ready for start-up. As a rule, the second mode will be utilized since even for a new run, the position of each decoder Ci, C'i can be calculated on the basis of the size and the geometrical position.

If the parts 5, 20, the axle suspensions 82, and especially the levers 8, represent a rigid design, the system described will be able to substitute itself for the cables. In this way, the cable function of the cylinder p is relegated to the infrastructural section, thus allowing a simpler execution of the cylinder to be conceived.

Nonetheless, the control disk will provide the operator at any moment with the possibility of increasing or reducing the distances between the axles of PP and PB or PB and CC with the machine running or at standstill, rendering possible changes:

on both sides simultaneously; or on either side separately, resulting in a biased position with tapered application of the pressure surface, though limited to a basic value. In case of a new asymmetrical command, the bias angle will then be maintained.

In all cases, however, the system ensures high rigidity.

The above described positional corrections are, however, limited in that:

the reduction of the distance between axles will entail a diminution of the pretension between the disk 4, 4' and the piston 21, 21', and ultimately the separation of the disk 4, 4' which, though, will be intercepted by the proximity detector switch SW. The distance between axles will, though, be automatically increased to a rate ensuring again the pretension, and hence the operational steadiness of the system.

the increase of the distance between axles will ultimately cause a stroke end contact and the worsening and finally the disappearance of the print.

The repetitive pressure position thus lies in the middle between the outermost and innermost points, and ensures a wide range of variable pressure rates.

On account of the relatively high weight of the cylinder PP, it is useful to connect also the joint point 83 to the outlet rod 400 of an ancillary jack Va with a connection such that with a chamber of the jack being subjected to pressure $a_1$, the rod 400 will be loaded by at least part of the weight of the cylinder PP, which arrangement will allow excessive crushing of the blanket B to be avoided. On the other hand, when the other chamber of the jack Va is subjected to a pressure $a_2$, the rod 400 will push the cylinder PP towards the cylinder PB. Thus, the pressure $a_2$ will increase the effect of the pretension.

The position of the second jack 2' is inversed with respect to the position of the jack 2. This means that the outlet rod 20' is directed downward. Each end of the central shaft 14' of the cylinder CC is able to rotate on a bearing 82' situated more or less in the middle of a horizontal lever 8', which can pivot freely around an axle 81' situated at the first end, the other end being connected to the end of the outlet rod 20' of the jack 2' by means of a joint 83'. Consequently, when the jack 2' is subjected to the pressure $b'_1$, its rod 20' has a tendency to pull the cylinder CC upward so as to press the web 100 against the cylinder PB.

In order to meet with the precision requirements for the positioning of the cylinder PP, an angular incremental decoder Ci with 512 steps/rev. is used. This design has been given preference so that, for instance with one step of the decoder Ci (3.76° of motor angle) will correspond to a 0.00195 mm shift of the cylinder PP, and that one step of the decoder C'i (4.34° of motor angle) will correspond to a 0.006 mm shift of the cylinder CC, this, in both cases, for a positioning accuracy of 0.01 mm being ensured by the cylinders PP and CC respectively.

With the machine running, it is possible to vary the compression of the blanket B by appropriately modifying the position of the cylinder PP. In the course of this corrective action, the motor M is to act against the pretension pressure. For this purpose, the control panel can be equipped with a push button of which a short impulse will correspond to one decoder step, i.e. about 0.001 mm at the nipping point of the cylinders PP and PB, whereas an impulse of more than 0.2 sec. will correspond to 9 decoder steps, i.e. 0.01 mm at the nipping point.

Corrections can also be carried out only at one end of the cylinder PP. However, care should be taken to avoid excessive biasing of the cylinder PP. Nonetheless, there is a possibility to limit biasing, for instance to a maximum of 0.20 mm, i.e. 179 difference steps between the two decoders Ci connected to each end of the cylinder PP. This limitation is achieved electrically. So, after a maximum bias, a new asymmetrical command is ensured by the two motors M, which action allows the maximum biasing to be maintained without increasing it. The biasing can, of course, be displayed on the control desk of the machine.

Obviously, all the printing units with the different colors of a printing machine can have their cylinders PP and CC provided with such monitoring devices with pretensioned jacks. In such a case, a single command rate controlling the jacks of PP or else the jacks of CC can be used on all printing units for simultaneous pressure throw-in and correction.

There is also a possibility of having the inking rollers equipped with such a device. Its volume would then be reduced accordingly.

Although various minor changes and modifications might be proposed by those skilled in the art, it will be understood that I wish to include within the claims of the patent warranted hereon all such changes and modifications as reasonably come within my contribution to the art.

I claim as my invention:

1. A device for controlling operating pressure between two rotary interactive cylinders to be used in a machine processing layers such as ink films, webs, or the like positioned at a contact line between the cylinders, comprising:

at least one of the two cylinders being supported by a central shaft and a movable bearing means supporting an end of the central shaft;

a pneumatic jack comprising a pressure tight sleeve and a movable piston therein with an outlet rod connected to act on and change a position of said movable bearing means, a pressure tight chamber means formed within the sleeve which can be pressurized for applying a pressure which will act on a first side of said piston in a direction opposing a change of position of the movable bearing means in a direction which would result in an increase of a distance and a resulting decrease of pressure at the contact line between the two cylinders;

an arresting piece means which can be selectively positioned to abut against the piston for preventing the movable bearing means from shifting in a direction which would result in a reduction of a predetermined distance and an increase of pressure at the contact line between the two cylinders;

the jack having a pressure chamber positioned at a second side of the piston which is opposite the first side, and wherein said arresting piece means is fitted inside the chamber on a threaded rod, said arresting piece means rotatably engaging the threaded rod such that by rotating the threaded rod, a position of the arresting piece means relative to the piston is adjustable;

a motor means and incremental angular decoder means being provided for driving and controlling the threaded rod so as to rotate it for precisely positioning the arresting piece means; and a first end of the threaded rod being received within a bearing means for permitting rotation of the threaded rod, said bearing means being located at an end wall of the sleeve of the jack, a toothed wheel attached at said first end of the threaded rod, means for connecting the toothed wheel for rotary drive to the motor means, a second end of the threaded rod being freely received within a hollow anterior of the outlet rod connected to the piston, and the motor means and said incremental decoder means being mounted to the sleeve.

2. A device for controlling operating pressure between two rotary interactive cylinders to be used in a machine processing layers such as ink films, webs, or the like positioned at a contact line between the cylinders, comprising:

at least one of the two cylinders being supported by a central shaft and a movable bearing means supporting an end of the central shaft;

a pneumatic jack comprising a pressure tight sleeve and a movable piston therein with an outlet rod connected to act on and change a position of said movable bearing means, a pressure tight chamber means formed within the sleeve which can be pressurized for applying a pressure which will act on a first side of said piston in a direction opposing a change of position of the movable bearing means in a direction which would result in an increase of a distance and a resulting decrease of pressure at the contact line between the two cylinders;

an arresting piece means which can be selectively positioned to abut against the piston for preventing the movable bearing means from shifting in a direction which would result in a reduction of a predetermined distance and an increase of pressure at the contact line between the two cylinders;

an arresting piece means which can be selectively positioned to abut against the piston for preventing the movable bearing means from shifting in a direction which would result in a reduction of a predetermined distance and an increase of pressure at the contact line between the two cylinders;

the jack having a pressure chamber positioned at a second side of the piston which is opposite the first side, and wherein said arresting piece means is fitted inside the chamber on a threaded rod, said arresting piece means rotatably engaging the threaded rod such that by rotating the threaded rod, a position of the arresting piece means relative to the piston is adjustable;

said chamber at the second side of the piston having means for providing access to free atmosphere through an adjustable exhaust opening and wherein said chamber at the second side is a pressure tight enclosure; and a proximity detector means being provided for emitting a signal indicative of a proximity of the arresting piece means relative to said second side of the piston.

3. A device according to claim 2 wherein auxiliary jack means is connected to the movable bearing means for augmenting a force resulting from the pressure provided in the pressure tight chamber means of the pneumatic jack.

4. A device according to claim 2 including motor means for rotating said threaded rod for precisely positioning the arresting piece means.

5. A device according to claim 2 wherein an incremental angular decoder means is connected to the motor means for detecting angular rotations of the threaded rod.

6. A device for controlling operating pressure between two rotary interactive cylinders to be used in a machine processing layers such as ink film, webs, or the like positioned at a contact line between the cylinders, comprising:

at least one of the two cylinders being supported by a central shaft and a movable bearing means supporting an end of the central shaft;

a pneumatic jack comprising a pressure tight sleeve and a movable piston therein with an outlet rod connected to act on and change a position of said movable bearing means, a pressure tight chamber means formed within the sleeve which can be pressurized for applying a pressure which will act on a first side of said piston in a direction opposing a change of position of the movable bearing means in a direction which would result in an increase of a distance and a resulting decrease of pressure at the contact line between the two cylinders;

an arresting piece means which can be selectively positioned to abut against the piston for preventing the movable bearing means from shifting in a direction which would result in a reduction of a predetermined distance and an increase of pressure at the contact line between the two cylinders;

the jack having a pressure chamber positioned at a second side of the piston which is opposite the first side, and wherein said arresting piece means is fitted inside the chamber on a threaded rod, said arresting piece means rotatably engaging the threaded rod such that by rotating the threaded rod, a position of the arresting piece means relative to the piston is adjustable;

a motor means and incremental angular decoder means being provided for driving and controlling the threaded rod so as to rotate it for precisely positioning the arresting piece means;

a proximity detector means being provided for emitting a signal indicating a proximity of the arresting piece means relative to said side of the piston; and the arresting piece means having a shape of a disk, an axis of which is coincident with an axis of the cylindrical sleeve and of the piston, means being provided within the sleeve for preventing the disk and the piston from rotating relative to the sleeve, said detector means being fitted inside a first end of a tube fixed to the piston, the tube extending parallel to said outlet rod and through a wall of said pressure tight chamber means and protruding therefrom, a sealed aperture means in said end wall providing a pressure tight seal but permitting a sliding motion of the tube relative to the cylindrical sleeve, and a wire means positioned within the tube for transmitting signals from the detector means.

* * * * *